US007112012B2

(12) United States Patent
Whitsett

(10) Patent No.: US 7,112,012 B2
(45) Date of Patent: Sep. 26, 2006

(54) PILING APPARATUS AND METHOD OF INSTALLATION

(76) Inventor: Michael Whitsett, 106 Ruffian Ct., Bush, LA (US) 70431

( * ) Notice: Subject to any disclaimer, the term of this patent is extended or adjusted under 35 U.S.C. 154(b) by 81 days.

(21) Appl. No.: 10/943,066

(22) Filed: Sep. 14, 2004

(65) Prior Publication Data

US 2005/0031418 A1 Feb. 10, 2005

Related U.S. Application Data

(63) Continuation of application No. 09/993,321, filed on Nov. 14, 2001, now Pat. No. 6,814,525.

(60) Provisional application No. 60/248,349, filed on Nov. 14, 2000.

(51) Int. Cl.
*E02D 7/28* (2006.01)
*E02D 5/38* (2006.01)

(52) U.S. Cl. ..... 405/233; 405/249; 405/251; 405/253; 52/741.15

(58) Field of Classification Search ..... 405/233, 405/243, 245, 249, 251, 253, 257; 52/741.15, 52/742.14, 745.12, 745.18, 157, 165, 726.1; 264/31, 35; 403/305
See application file for complete search history.

(56) References Cited

U.S. PATENT DOCUMENTS

| | | | | |
|---|---|---|---|---|
| 415,037 | A | | 11/1889 | Gray |
| 1,087,334 | A | | 2/1914 | Stevens |
| 2,326,872 | A | | 8/1943 | Mardsen |
| 2,926,500 | A | | 3/1960 | Hoppe |
| 3,354,657 | A | | 11/1967 | Turzillo |
| 3,422,629 | A | | 1/1969 | Watts |
| 3,864,923 | A | | 2/1975 | Turzillo |
| 3,938,344 | A | | 2/1976 | Asayama |
| 3,962,879 | A | | 6/1976 | Turzillo |
| 4,678,673 | A | | 7/1987 | Marshall et al. |
| 4,756,129 | A | * | 7/1988 | Webb ..... 405/244 |
| 5,066,167 | A | | 11/1991 | Siegfried et al. |
| 5,459,973 | A | * | 10/1995 | Baumann ..... 52/726.1 |
| 5,653,069 | A | * | 8/1997 | Dziedzic ..... 405/244 |
| 5,707,180 | A | | 1/1998 | Vickars et al. |
| 5,975,808 | A | | 11/1999 | Fjuita |
| 6,050,740 | A | * | 4/2000 | Dziedzic ..... 405/232 |
| 6,264,402 | B1 | * | 7/2001 | Vickars et al. ..... 405/239 |
| 6,551,030 | B1 | * | 4/2003 | Curry ..... 405/251 |

* cited by examiner

*Primary Examiner*—Michael Safavi
(74) *Attorney, Agent, or Firm*—Keaty Professional Law Corporation

(57) ABSTRACT

An in-situ pile apparatus 10 includes a helical anchor to which a plurality of elongated generally cylindrically shaped sections can be added. Each of the sections has a specially shaped end portion for connecting to another section. An internal drive is positioned in sections inside the bore of each of the connectable pile sections. The internal drive includes enlarged sections that fit at the joint between pile sections. In one embodiment, the internal drive can be removed to leave a rod behind that defines reinforcement for an added material such as concrete. The rod also allows for a tension rod connection from the anchor tip to an upper portion attachment point.

6 Claims, 11 Drawing Sheets

PILING APPARATUS AND METHOD OF INSTALLATION

CROSS-REFERENCE TO RELATED APPLICATIONS

This application is a continuation of my application Ser. No. 09/993,321 filed on Nov. 14, 2001 now U.S. Pat. No. 6,814,525, entitled "Piling Apparatus and Method of Installation," now allowed, which claims the benefits of priority of U.S. Provisional Patent Application Ser. No. 60/248,349, filed Nov. 14, 2000, full disclosures of which incorporated herein by reference, are hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to composite piling and more particularly to a piling apparatus that includes a helical anchor lower end portion to which a plurality of connectable sections can be added, each section having a hollow interior through which a drive member can pass, and each section being joined to another section at a joint that has a specially shaped fitting to be engaged by an enlarged portion of the drive member.

2. General Background of the Invention

Piling must often be installed in locations wherein a full size pile driving rig simply cannot be positioned. For example, if a building is having a settlement problem, piling must necessarily be driven below the building to support its lower most structural aspect, such as the lowest concrete horizontal section or slab.

It has been known in the art to cut holes through the slab of a building and then install a screw type anchor or screw type anchor piling system, in order to add support to an existing piling system that is already under the building. Once these additional piling have been placed, structural ties can be made between the building itself and the new piling.

Because pile driving equipment is not able to fit into the ground floor of existing buildings, a screw threaded piling or helical anchor is employed because it can be installed using a hydraulic rotary drive, for example. Such drive units are commercially available.

High capacity pile driving equipment is large and cumbersome to operate in confined areas. Conventional pile driving equipment can cause stress and fatigue on adjacent structures from weight and vibration.

Piles are used to support structures, such as buildings, when the soil underlying the structure is too weak to support the structure. There are many techniques that may be used to place a pile. One technique is to cast the pile in place. In this technique, a hole is excavated in the place where the pile is needed and the hole is filled with cement. A problem with this technique is that in weak soils the hole tends to collapse. Therefore, expensive shoring is required. If the hole is more than about 4 to 5 feet deep then safety regulations typically require expensive shoring and other safety precautions to prevent workers from being trapped in the hole.

It is known to provide a cylindrical foundation support element having an open lower end and which may be rotatably driven into the ground by virtue of the provision of an integral annular helix permanently affixed to the outer surface of the lower end of the support. The helix has an earth penetrating edge, and in conjunction with the cylindrical foundation defines an opening through which soil is allowed to pass into the chamber formed by the cylindrical wall of the foundation support. The opposite end of the cylindrical foundation support is adapted for releasable locking engagement to a drive element, which is used to rotate the support in a given direction, thus driving the support into the ground to a desired depth.

Langenbach Jr., U.S. Pat. No. 4,678,373 discloses a method for supporting a structure in which a piling beating a footing structure is driven down into the ground by pressing from above with a large hydraulic ram anchored to the structure. The void cleared by the footing structure may optionally be filled by pumping concrete into the void through a channel inside the pile. The ram used to insert the Langenbach Jr. piling is large, heavy and expensive.

Another approach to placing piles is to insert a hollow form in the ground with the piles desired and then to fill the hollow form with fluid cement. Hollow forms may be driven into the ground by impact or screwed into the ground. This approach is cumbersome because the hollow forms are unwieldy and expensive. Examples of this approach are described in U.S. Pat. Nos. 2,326,872 and 2,926,500.

Helical pier systems, such as the CHANCE™ helical pier system available from the A. B. Chance Company of Centralia, Mo. U.S.A., provide an attractive alternative to the systems described above. As described in more detail below, the CHANCE helical pier system includes a helical screw mounted at the end of a shaft. The shaft is configured to draw the helical screw downwardly into a body of soil. The screw is screwed downwardly until the screw is seated in a region of soil sufficiently strong to support the weight which will be placed on the pier.

Many piling systems have been patented that include multiple sections, some of which are provided with screw anchors or helical anchors.

An early patent is the Gray patent entitled "metal Pile", U.S. Pat. No. 415,037.

The Stevens U.S. Pat. No. 1,087,334, discloses and incased concrete piling.

A method for installing anchoring or supporting columns in situ is disclosed in U.S. Pat. No. 3,354,657.

A piling that includes a cylindrical foundation support drivable into ground with a removable helix is disclosed in the Holdeman U.S. Pat. No. 5,066,168.

The Watts U.S. Pat. No. 3,422,629 discloses a construction support system and method and apparatus for construction thereof. A helical member is part of the apparatus.

U.S. Pat. No. 3,864,923 discloses a method and means for providing a pile body in an earth situs, including driving casing into situs to define a cavity of required depth. An auger positioned within the casing is rotatable in screwing direction to remove earth from defined, cavity, and carries expansible cutter means rotatable with auger to enlarge cavity girth below inner end of casing. Earth removed from casing and cavity enlargement is replaced with different material, such as self-hardenable cement, to form pile body with load carrying enlargement at inner end of casing.

An earth auger is disclosed in U.S. Pat. No. 3,938,344 in which an auger shaft is provided with freely expansible and contractible rotary blades in such manner that said rotary blades may expand automatically when said auger shaft is rotated in the forward direction and may contract automatically when said auger shaft is rotated in the reverse direction. Also a method for driving piles and the like is disclosed which comprises the steps of positioning a pile or shoring adjacent to said auger shaft and above said blades, advancing said pile or the like into an earth bore excavated by said rotary blades, and filling said bore excavated by the rotary blades with mortar or the like.

The Turzillo U.S. Pat. No. 3,962,879 discloses a concrete pile or like concrete column formed in earth situs by rotating a continuous flight auger consisting or one or more sections into the earth to form a cavity of given depth; rotating the auger to remove augered earth from the cavity without removing the auger therefrom, and replacing the removed earth from the auger flights with fluid cement mortar, which hardens to form a column reinforced by the auger resultantly anchored in the same. A plurality of short auger sections may be connected together in succession during drilling to form a cavity of requisite depth by increments when low headroom conditions exist. A portion of the auger or a shaft portion without auger flighting thereon may also protrude above the earth situs for extension through water and the like and be filled with cementitious material which is allowed to harden. The method may also include first filling the auger shaft with the fluid mortar and allowing the same to harden in the shaft with a passage extending therethrough, and supplying more mortar through the passage to fill the cavity to form the column against backing of hardened mortar in the shaft.

The Vickars U.S. Pat. No. 5,707,180 discloses a method and apparatus for forming piles in situ. The '180 patent provides a method for making piles and apparatus for practicing the method. The piles may be used to support the foundation of a structure, such as a building. The method draws a soil displacer on a shaft down through a body of soil by turning a screw at the lower end of the shaft. The soil displacer forces soil out of a cylindrical region around the shaft. The cylindrical region is filled with grout to encapsulate and strengthen the shaft. The grout may be fed by gravity from a bath of grout around the shaft. The soil displacer has a diameter smaller than a diameter of the screw and may be a disk extending in a plane generally perpendicular to the shaft.

BRIEF SUMMARY OF THE INVENTION

The present invention provides an improved method and apparatus for forming piles in situ. The apparatus of the present invention includes a lower helical screw anchor to which are attached a number of add on sections.

The present invention utilizes a screw threaded piling or helical anchor because it can be installed in confined areas, using smaller and more agile equipment (such as a Bobcat® type skidsteer equipped with a boom mounted hydraulic powered high torque planetary auger drive made by Eskridge., for example). Such units as these are commercially available.

In the preferred embodiment, each section is in the form of a hollow member (eg. thin wall pipe such as 0.188" wall thickness or 0.125 wall thickness or Schedule 10 pipe) having a bore that receives a drive member or tool. The outer surface of each of the sections has soil displacing ribs that aid in pushing soil away from the sections as the pile apparatus is screwed down into the earth. The hollow bore of each of the sections receives an elongated drive member. The drive member is comprised of connectable sections wherein each of the connectable drive sections is about the same length as each of the pile sections. An enlarged drive member is provided at intervals as part of the drive member, the enlarged section registering with a correspondingly shaped joint that connects two pile sections together.

The present invention provides an improved method and apparatus for installing an in-situ pile apparatus.

A lower helical anchor lead unit with variable size helical discs is screwed into the soil, followed by a conically shaped cutting and soil displacing unit. This unit has strategically placed (2–4) triangular ribs for cutting and displacing soil outwardly away from the sectional pipe sections. This same unit will work as a pile cap for concrete that is poured into upper pipe sections. With this improved shape, it cuts the soil when rotated. The upper flat round plate of the conical will work as a bearing plate to the soil.

Once the conical unit has reached the soil, a drive tool will be attached to the helical lead unit, connected with a plastic or wooden dowel placed through the typical bolt hole.

A formed (thin wall 0.188" or Schedule—10 0.125") pile section that has squared ends is placed over the drive tool and bolted to the conical unit. Silicone caulking can be installed at each square section makeup joint to prevent water or mud from entering the pipe sections.

A hydraulic planetary drive unit is attached to the square drive tool. The hydraulic auger driver unit is engaged and the helical anchor, conical unit, attached pipe section(s) will be screwed downwardly into the soil. The hydraulic auger unit is then stopped and removed.

A second drive installation tool is bolted to the first. A second formed square sectional hollow form is placed over the drive tool and bolted. The hydraulic planetary drive unit is placed on top of the drive tool and the complete pile section is then screwed down into the soil until the top section reaches near ground level. This same process of installing drive tools and sectional hollow form units is repeated until the proper depth form has been reached (i.e. to satisfy the pile load requirements). As the complete pile unit is screwed down into the earth, the soil displacer ribs will push the soil outward away from the hollow pipe sections, creating less friction on the sections and therefore less torque.

With the proposed pile apparatus, the helical anchor will pull the hollow pipe forms down. At the same time the soil displacer ribs push the soil radially. This will allow the pile to penetrate deeper with less friction and a truer ft. lb. torque to capacity ratio. This method allows the pile to be installed as a point bearing pile, relying on the capacity of the helical discs that are screwed into the soil. In time, soil will reconsolidate around the larger diameter pipe forms which will develop a known friction capacity which will increase the overall pile capacity.

In one embodiment, a rod is provided that can be left with the pile section upon completion of installation to act as tensile rod or reinforcement for concrete that can be added to the internal bores of the various pile sections as connected end to end.

In another embodiment, plastic pipe sections can be added to the pile sections such as for example in water installations, the plastic pipe sections extending between the mud line and water surface.

Other embodiments show various connectors for attaching the internal drive members together and for connecting the rod sections together.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1A:
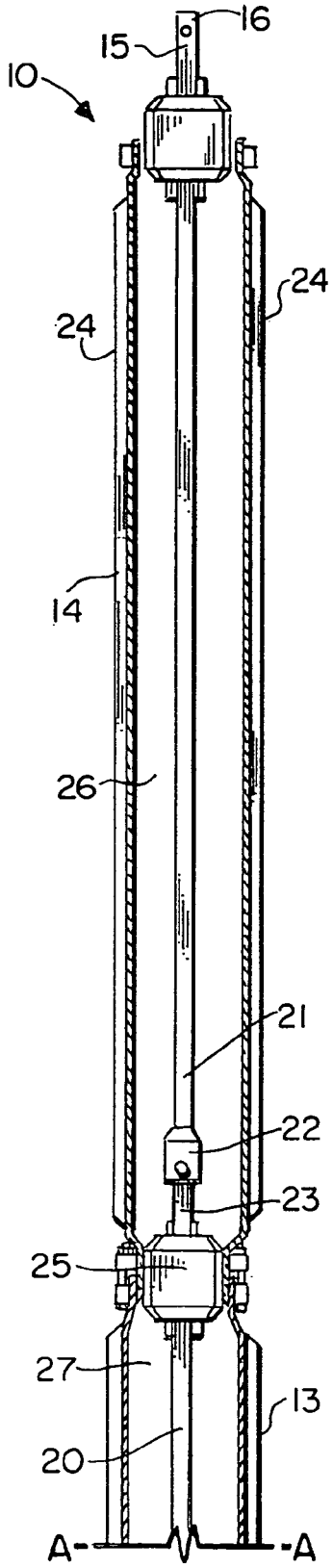
FIGS. 1A–1C disclose the preferred embodiment of the apparatus of the present invention, wherein FIG. 1A fits the drawing FIG. 1B at match line A—A and wherein the drawing FIG. 1B fits the drawing FIG. 1C at match line B—B.
Figure 1B:
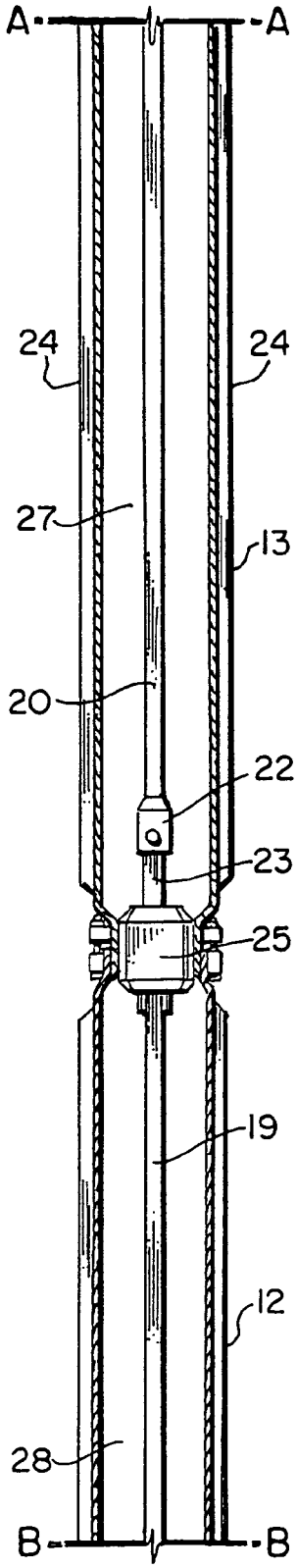
Figure 1C:
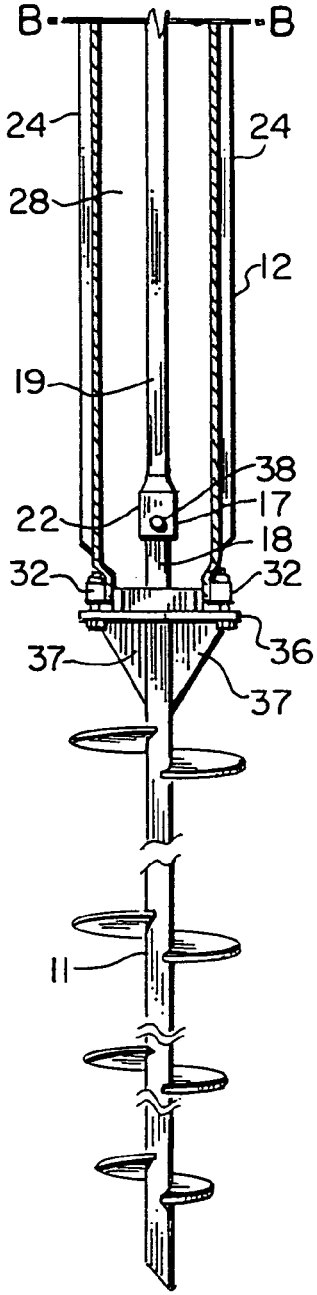

In FIGS. 1A–1C, the preferred embodiment of the apparatus of the present invention is designated generally by the numeral 10. It should be understood that in order to fit an entire elevation, sectional view of the apparatus 10 of the present invention on a single page, matchline type drawings are used wherein FIG. 1A fits to the top of FIG. 1B along matchlines A—A. Similarly, FIG. 1C fits to the bottom of FIG. 1B at matchlines. In situ pile apparatus 10 includes generally a lowermost, first section in the form of helical anchor 11, a second section 12 which is a hollow pile form section, a third section 13 and a fourth section 14. The third and fourth sections 13, 14 are also hollow pile form sections. Each section 12, 13, 14 has an internal bore. Section 12 has bore 28. Section 13 has bore 27. Section 14 has bore 26.

In the preferred embodiment, the sections 12, 13, 14 are preferably interchangeable pile sections. An internal drive member 15 extends through a hollow bore of each of the sections 12, 13, 14. The drive member 15 has an upper end portion 16 to which a commercially available hydraulic rotary drive motor can be attached. The drive member 15 has a lower end portion 17 that forms an attachment with an extension 18 at the upper end of helical anchor 11.

The drive member 15 can be comprised of a number of connectable sections as shown, including drive sections 19, 20, 21. Each drive section 19, 20, 21 provides a lower connector 22 (for example, a female connector) that forms a connection with an upper connector 23 (for example, a male connector). The lowest drive section 19 provides a connector 22 that forms a connection with extension 18 of helical anchor 11 as shown in FIG. 1C.

The internal drive 18 and member 15 is positioned internally of pile sections 12, 13, 14 and occupying the respective bores 28, 27, 26 as shown in FIGS. 1A, 1B, 1C, 2, 4, and 11–13.

Figure 2:
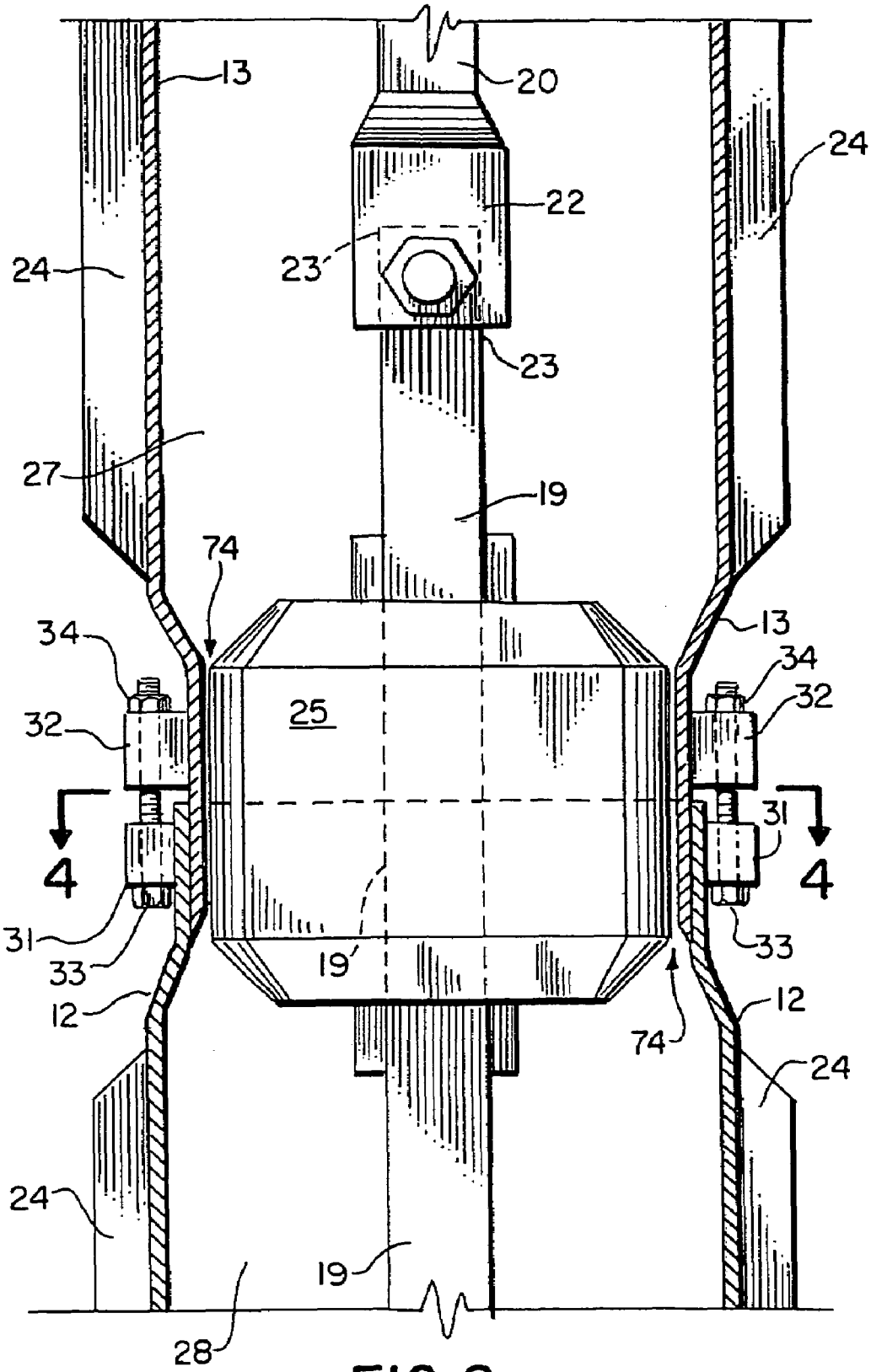
FIG. 2 is a schematic sectional elevational view of the preferred embodiment of the apparatus of the present invention illustrating a joint between two pile sections.

In FIG. 2, an enlarged view shows the joint between second section 12 and third section 13. It should be understood that a similar connection is formed between section 13 and section 14. In FIG. 2, each of the sections 12, 13 has a plurality of circumferentially spaced radially extending soil displacing ribs 24. Soil displacing ribs 24 can also be seen in the plan view of FIG. 4. The drive section 19 carries an enlarge drive member as shown in FIGS. 2 and 5.

Figure 3:
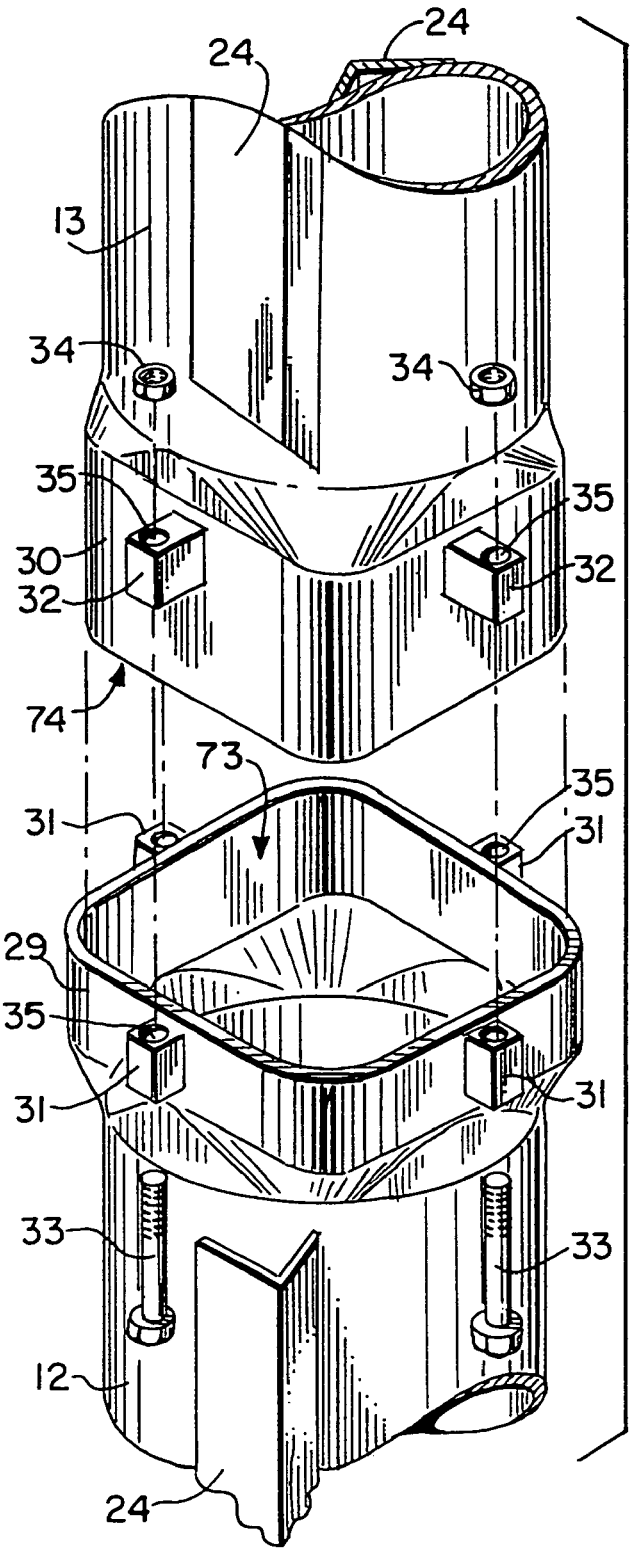
FIG. 3 is a partial, perspective view of the preferred embodiment of the apparatus of the present invention.
Figure 4:
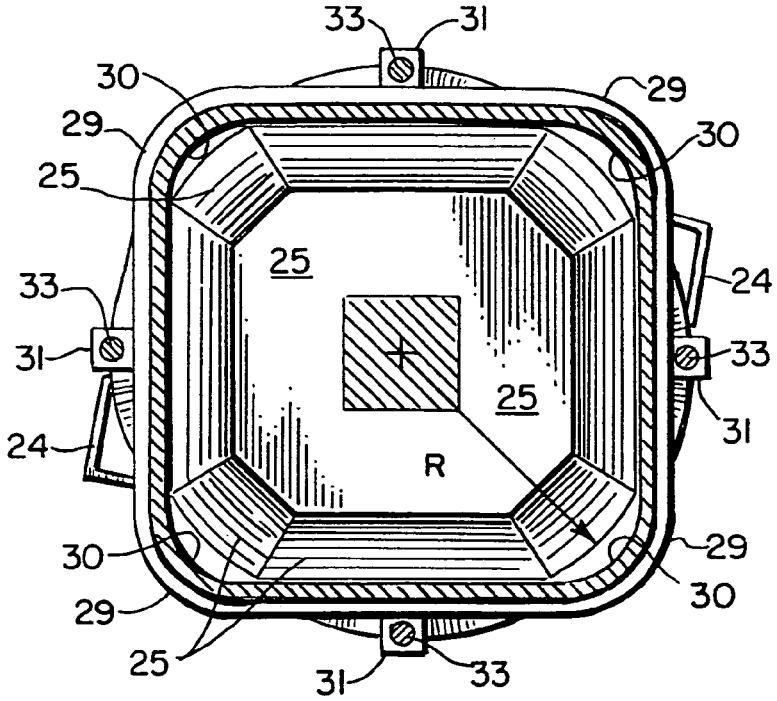
FIG. 4 is a sectional view taken along lines 4—4 of FIG. 2.
Figure 5:
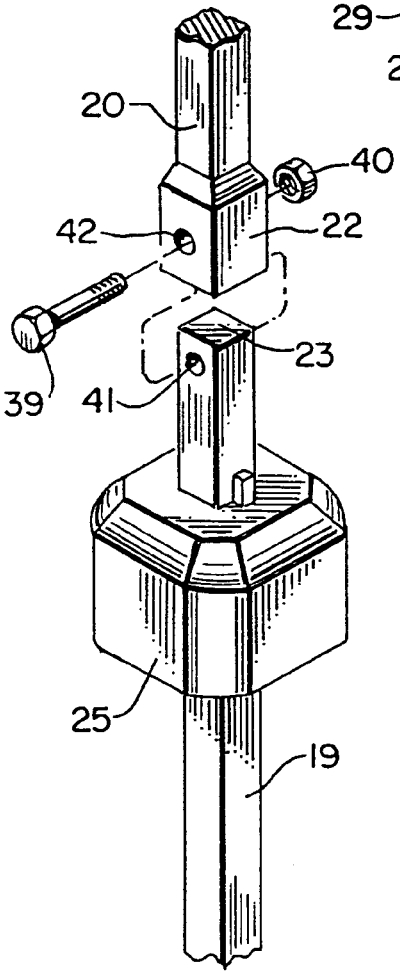
FIG. 5 is a partial perspective view of the preferred embodiment of the apparatus of the present invention illustrating the drive portion thereof.
Figure 6:
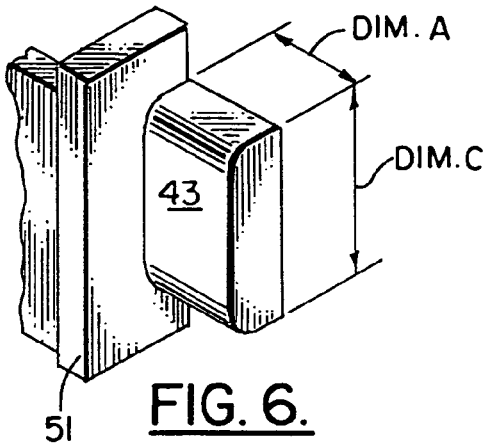
FIGS. 6 and 7 are partial perspective views of the preferred embodiment of the apparatus of the present invention illustrating die members that can be used to form the joint that is at the end of each of the pile sections.
Figure 7:
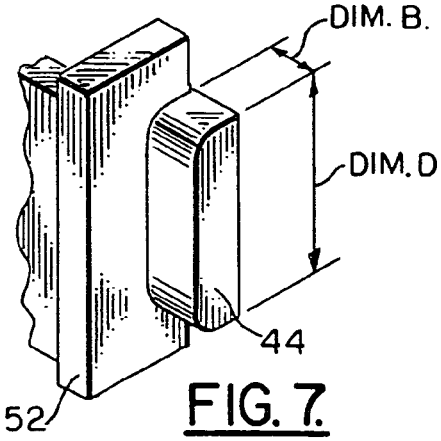

In FIGS. 2, 3, and 4, the details of a connection between a pair of pile sections is shown such as, for example, between the second pile section 12 and the third pile section 13. In FIGS. 2–4, the pile section 12 has an upper end portion that provides an upper squared end portion 29. Similarly, the third pile section 13 provides a lower square end portion 30 that has a socket 73 that is slightly smaller than the square end portion 29 so that the end portion 30 fits into the section 29 at socket 73 forming a snug fit therewith.

Each of the square end portions 29–30 provides a plurality of lugs. The upper square end portion 29 provides a plurality of lugs 31. The lower square end portion 30 provides a plurality of lugs 32. Each of the lugs 31, 32 provides an opening 35 through which a bolted connection can be placed as shown in FIGS. 1A–1C, and 2–4. The bolted connections include a plurality of bolts 33 and a plurality of nuts 34 as shown.

As shown in FIG. 2, the lower squared end portion 30 at the bottom of pile section 13 fits snugly into the socket 73 of upper square end portion 30 at the top of pile section 12. As shown in FIG. 2, enlarged drive member 25 of internal drive member 15 closely fits and conforms to the assembly of upper square end portion 29 and lower end portion 30 as shown. Enlarged drive member 25 occupies the socket 74 at the lower end portion of pile section 13 (see FIG. 2).

In the preferred embodiment, an enlarged drive member 25 is positioned at every joint between pile sections such as shown in FIGS. 1A–1B. However, it should be understood that any desired number of pile sections 12, 13, 14 can be added to configure or "make-up" a very long pile apparatus. As each pile section 12, 13, 14 is added, an additional drive section such as 19, 20, 21 is added, in each case an enlarged drive member 25 registering at the joint between sections such as 12 and 13 as shown in FIG. 2

Figure 11:
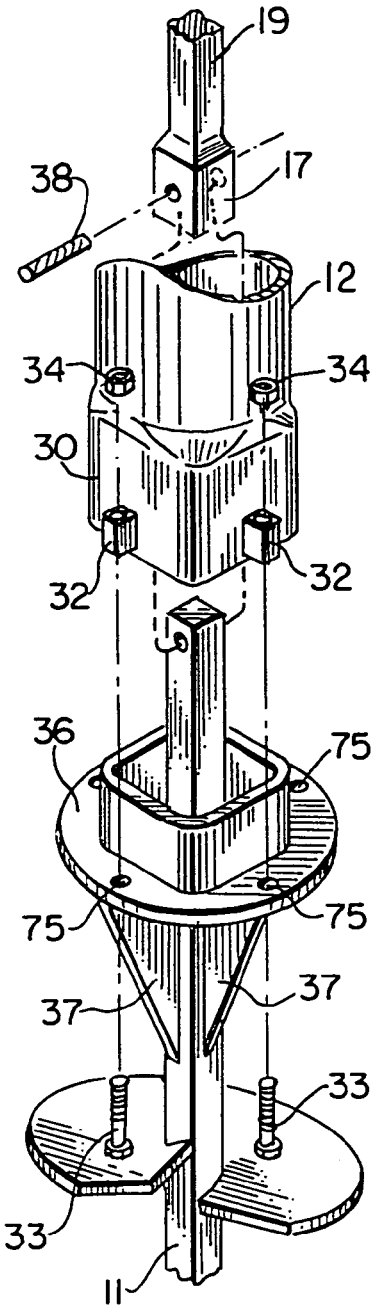
FIG. 11 is a partial, perspective view of the preferred embodiment of the apparatus of the present invention.

When bolting the helical anchor 11 to lower square end portion 30 of a pile section such as 12 (see FIG. 11), the anchor 11 provides a round plate 36 having peripheral openings 75 through which bolts 33 can pass as shown in FIG. 1C. For stiffening and soil cutting and soil displacement purposes, a plurality of radially extending triangular plates 37 are provided at the upper end portion of helical anchor 11 just below plate 36 as shown in FIGS. 1C and 11.

Figure 13A:
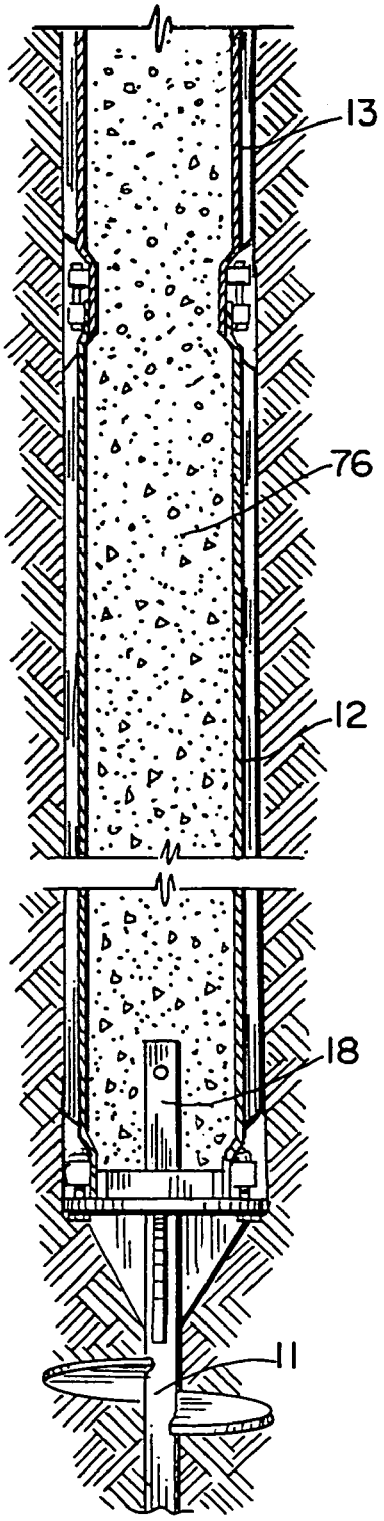
FIG. 13A is a partial, sectional view of the preferred embodiment of the apparatus of the present invention showing drive tool removed and concrete added.
Figure 13:
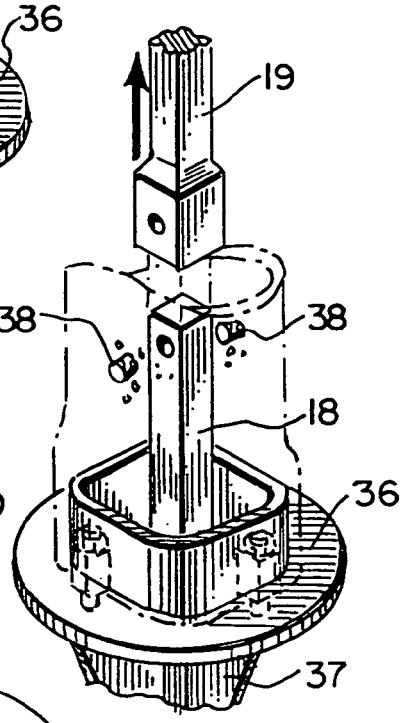
FIG. 13 is another partial, perspective view of the preferred embodiment of the apparatus of the present invention.

In FIGS. 13–13A, the apparatus 10 of the present invention is shown after placement and wherein the bore 26, 27, 28 of each of the sections 12, 13, 14 is filled with a suitable filler material such as concrete and rebar reinforcement. In such a case, the connection between the extension 18 of helical anchor 11 and the lower end portion 17 of drive section 19 is broken by simply pulling up on the various components of the drive member 15 to shear pin (eg. wood or plastic) 38 (see FIG. 13). At other locations such as the connection between drive section 19 and drive section 20, a strong bolted connection using bolt 39 and nut 40 can be provided as shown in FIG. 5, passing through openings 41 in drive member 19 and opening 42 in drive member 20.

FIGS. 6–9 and 10A–10B show a die construction for forming upper squared end portion 29 and lower squared end portion 30. A pair of dies 43, 44 can be provided, the die 43 being used for forming the lower squared end portion 30 and thus having a longitudinal dimension A that is longer than the corresponding dimension B of die 44, and a transverse dimension C that is smaller than the transverse dimension D of die 44. The die 43 in FIG. 6 forms the smaller cross sectional, but longitudinally longer lower squared end portion 30 whereas the die 44 in FIG. 7 forms the transversely wider but longitudinally shorter upper squared end portion 29.

Figure 8:
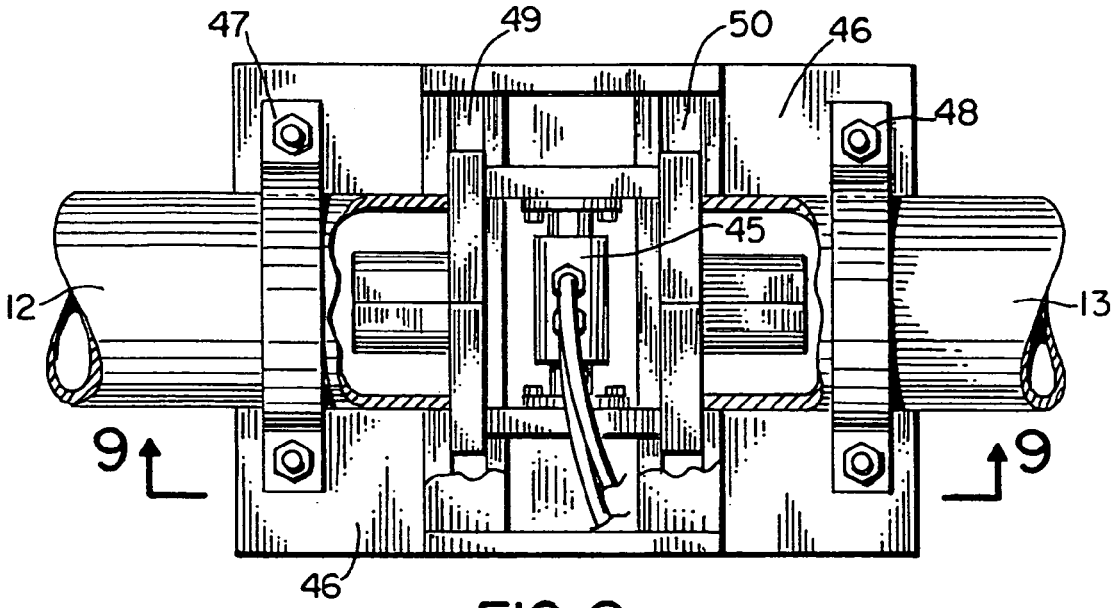
FIGS. 8 and 9 are plan and elevation views respectively that illustrate the method of forming the pile joint sections.
Figure 9:
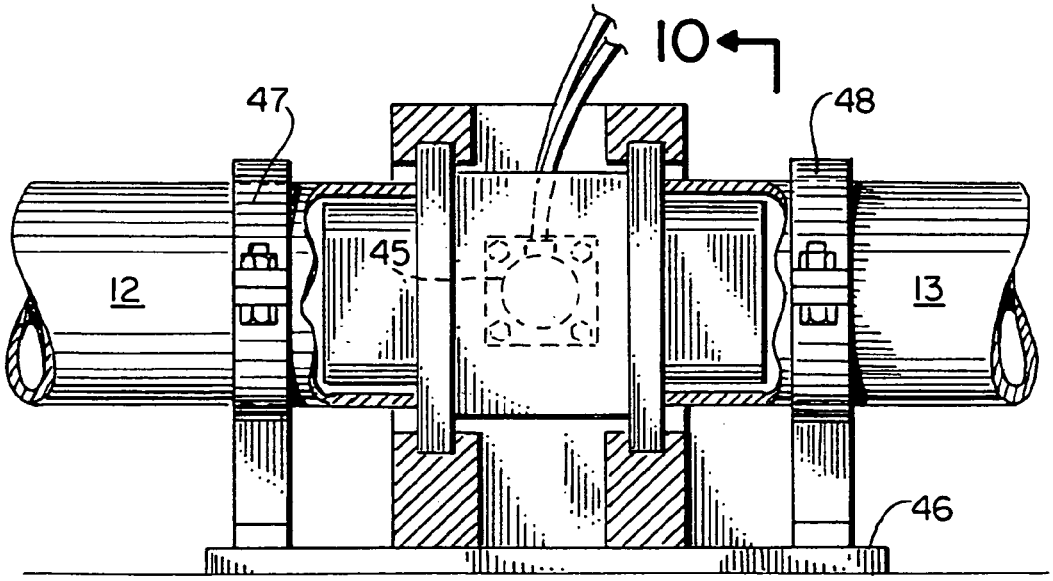
Figure 10:
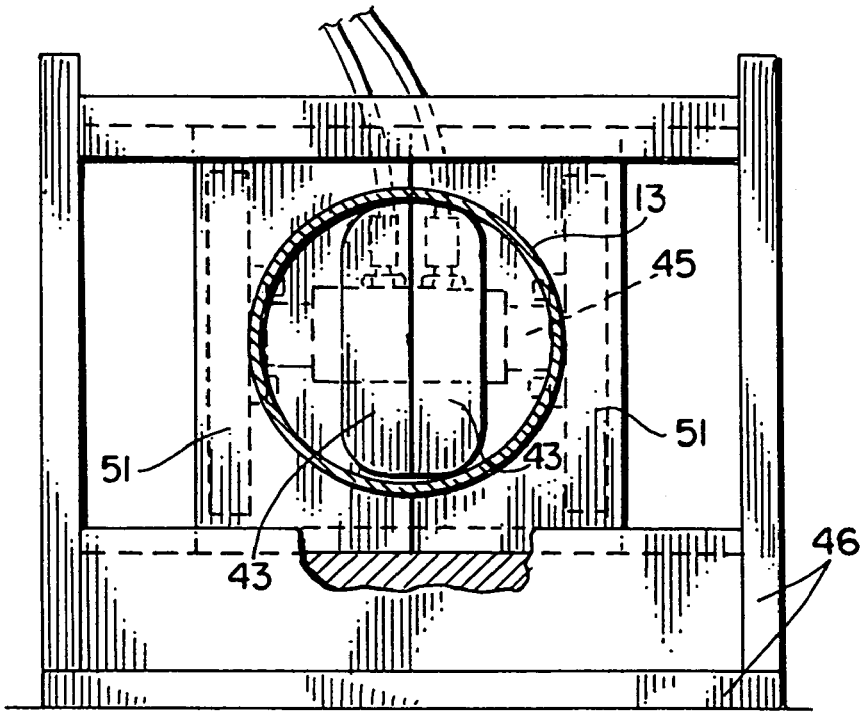
FIGS. 10 and 10A are schematic illustrations showing the formation of the joint sections that are at the end of each of the pile sections.
Figure 10A:
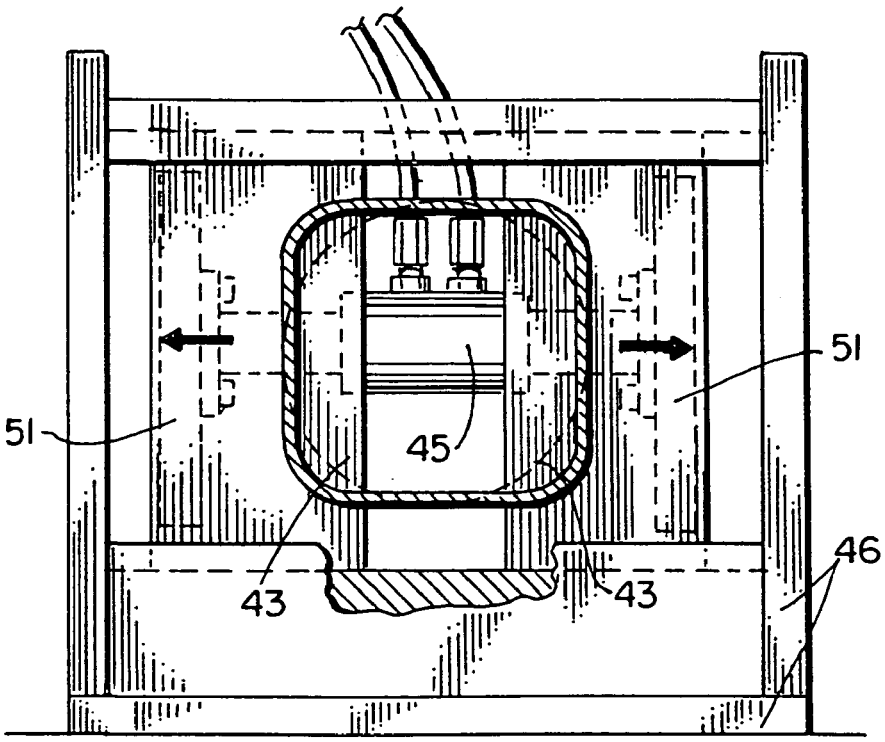

FIGS. 8 and 9 illustrate formation of these end portions 29 and 30 using a hydraulic jack 45 to force corresponding pairs of these dies 43, 44 apart while support 46 has clamp members 47, 48 that securely hold sections 12, 13. The support 46 thus functions as a slide top having runways 49, 50 that receive and track die supports 51, 52 that carry dies 43, 44 respectively.

Figure 12:
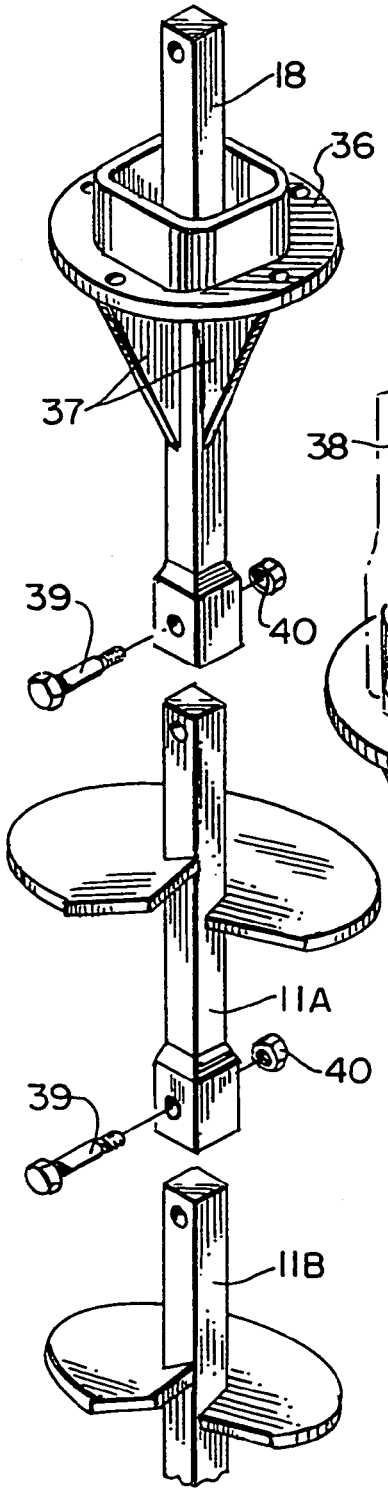
FIG. 12 is another partial, perspective view of the preferred embodiment of the apparatus of the present invention.

In FIG. 12, it should be understood that the helical anchor 11 can include a number of connected sections such as 11A, 11B connected together using bolted connections 39, 40 that are similar to the connections shown in FIG. 5.

Figure 14:
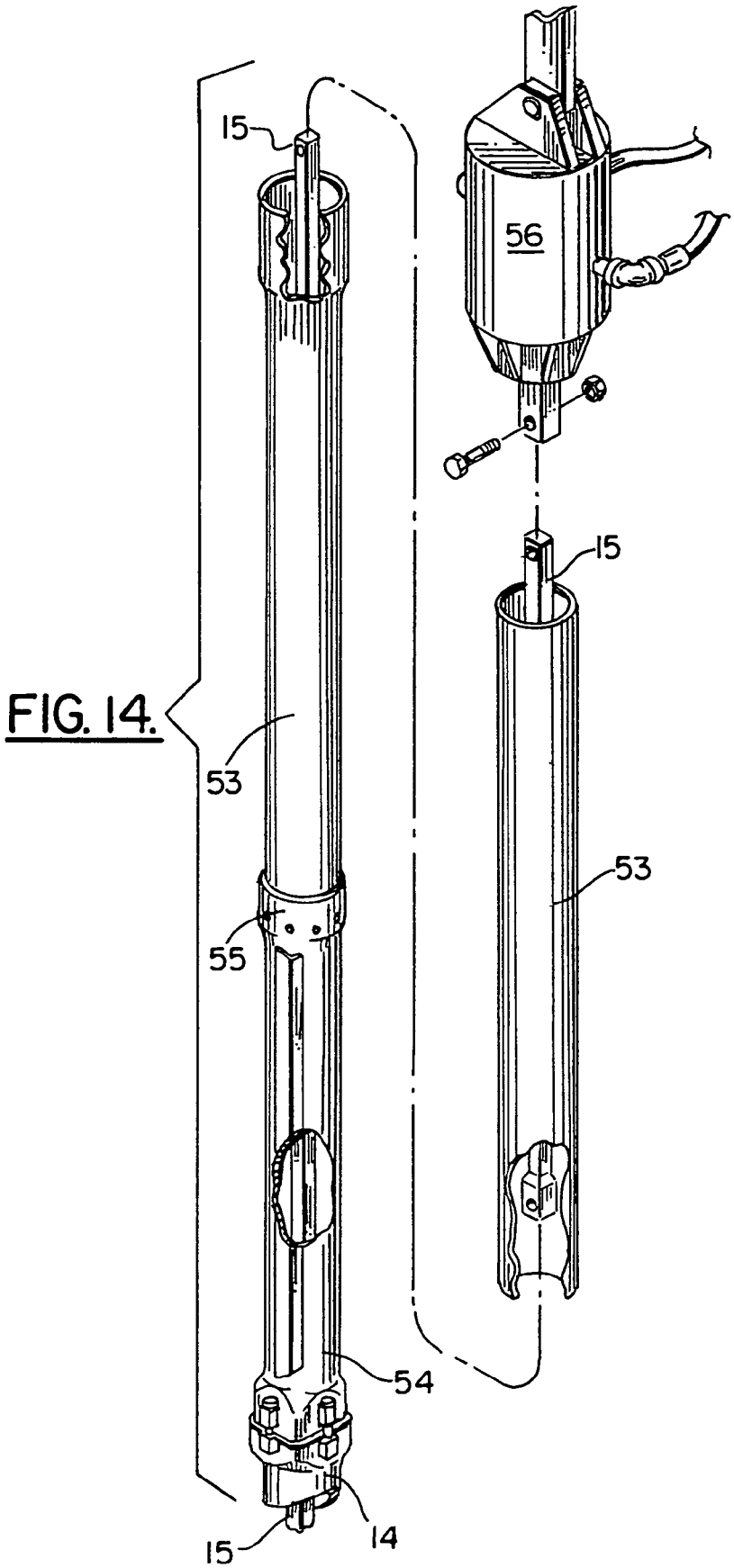
FIG. 14 is a partial, perspective view of the preferred embodiment of the apparatus of the present invention illustrating the hydraulic drive connected to the drive member, and showing an alternate construction that uses a hollow plastic water barrier pipe section that is adapted for use in between a water bed and a water surface.

FIG. 14 illustrates a system that can be used in water wherein a plastic cylindrical pipe section or sections 53 can be joined to an uppermost section such as 12, 13, 14 using rivets and/or glue. In such a situation, the pile section that is the upper most section (such as section 13 or 14 in FIG. 1A) will be replaced with a transition section 54 having a circular connector 55 that receives the lower end portion of pipe section 53. The internal drive 15 extends through the plastic pipe section 53 for connecting with hydraulic drive 56. As shown in FIG. 14, more than one of the plastic pipe sections 53 can be employed as a water barrier pipe means, connected end to end and glued as is known in the art.

The embodiment of FIG. 14 can be used in aquatic environments wherein the pipe sections 53 extend between the mud line and the water line and/or can be used in any corrosive environment.

Figure 15:
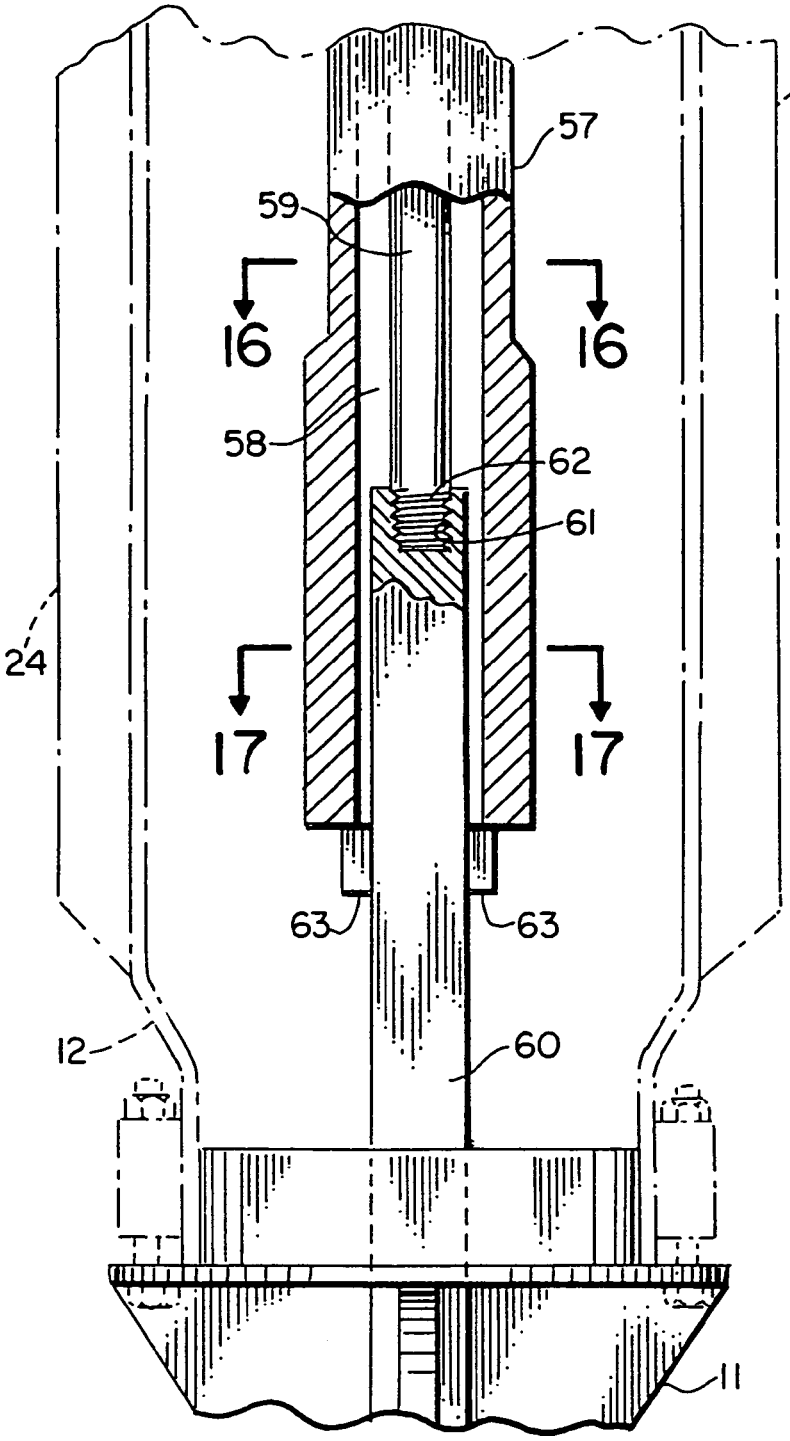
FIG. 15 is a partial elevation, sectional view of an alternate construction for the drive member.
Figure 16:
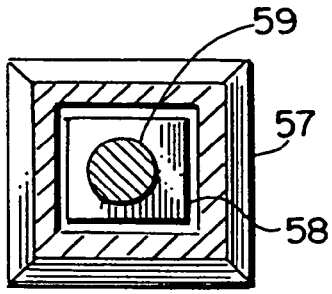
FIG. 16 is a sectional view taken along lines 16—16 of FIG. 15.
Figure 17:
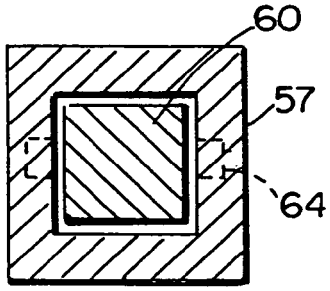
FIG. 17 is a sectional view taken along lines 17—17 of FIG. 15.
Figure 18:
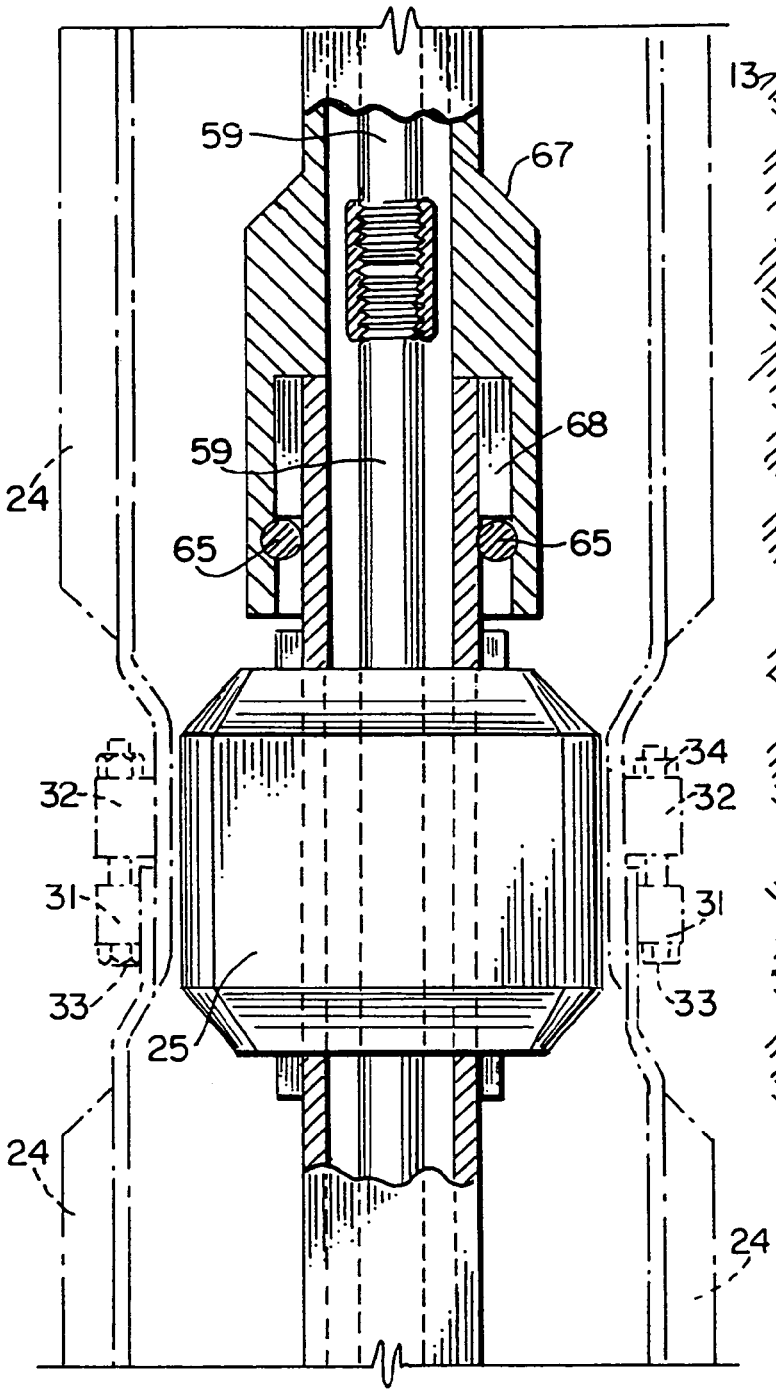
FIG. 18 is a partial, sectional elevation view illustrating an alternate construction for the internal drive member.
Figure 22:
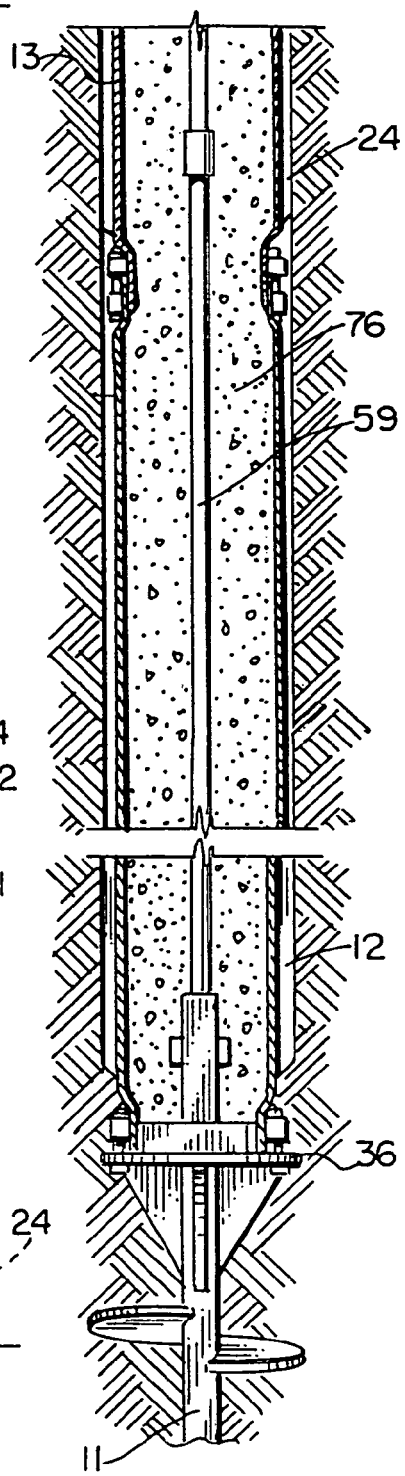
FIG. 22 is a sectional, elevation view showing the system of FIGS. 18–21 after installation.

FIGS. 15–17 shown an alternate arrangement for the internal drive member 15. In FIGS. 15–17, each of the internal drive members 15 is replaced with a specially configured drive member 57 wherein each of the drive members is hollow, providing a bore 58 that receives internally positioned rod 59. The extension 18 of anchor 11 is replaced with an extension 60 that has an upper end portion that is internally threaded at 61 to receive an externally threaded portion 62 at the lower end of rod 59 as shown in FIG. 15. This construction enables the drive member 57 to be removed, leaving the rod 59 behind for reinforcement purposes.

Radially extending projections 63 on extension 60 stop the drive tool 57 from slipping down the shaft 60. Torque can be imparted from drive member 57 to extension 60 and thus to helical anchor 11.

Figure 20:
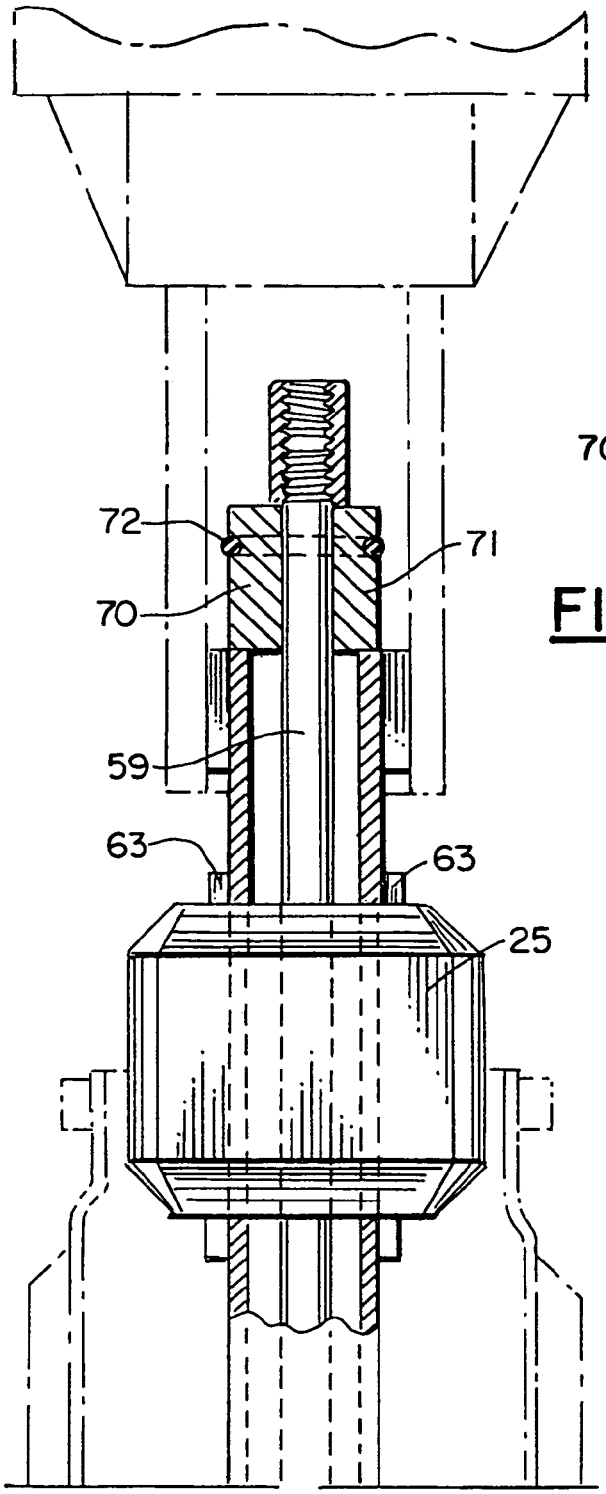
FIG. 20 is a partial, sectional elevation view illustrating the connection of FIGS. 18 and 19.
Figure 21:
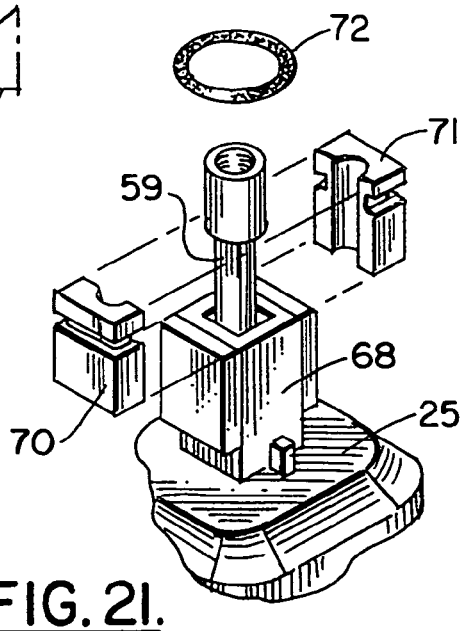
FIG. 21 is a partial, perspective, exploded view illustrating the connection of FIGS. 18–20.
Figure 19:
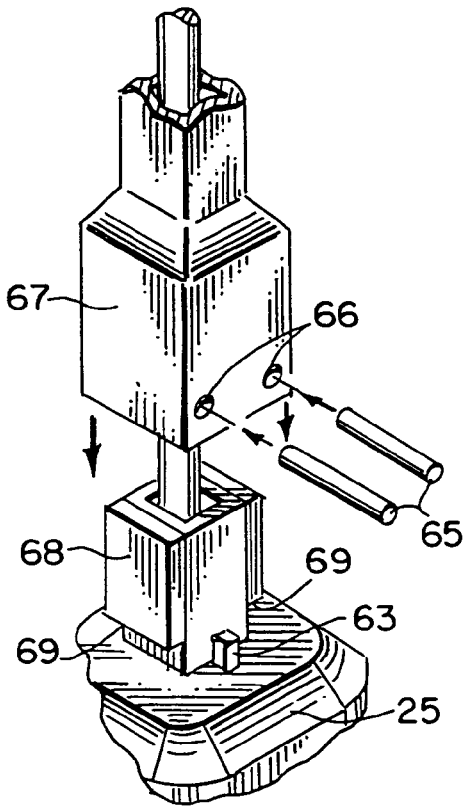
FIG. 19 is a partial perspective view of the connection shown in FIG. 18.

In order to remove the internal drive member 57, the operator simply lifts the drive member 57 off the stops 63, disengaging the drive tool 57 from extension 60. FIGS. 18–22 show another arrangement for connecting internal drive member 57 to an enlarged drive member 25 as shown in FIGS. 19–21.

in FIGS. 19–21, a pair of steel pins 65 are inserted through openings 66 when the lower end 67 of a drive member section is to be connected to another drive member section. The drive member section 67 fits over the fitting 68 above enlarged drive member 25 and pins 65 are placed through openings 66 and under horizontal surfaces 69.

FIG. 21 shows two (2) drive tool retainer clamps 70, 71 held together by the O-ring 72. The retainer clamps 70, 71 grip rod 59 and thus hold the shaft of the drive tool 57 to prevent it from moving up during installation. Once the drive tool 57 is installed, the clamps 70, 71 are removed.

PARTS LIST

The following is a list of suitable parts and materials for the various elements of the preferred embodiment of the present invention.

| PART NO. | DESCRIPTION |
|---|---|
| 10 | in-situ pile apparatus |
| 11 | helical anchor, first section |
| 11A | anchor section |
| 11B | anchor section |
| 12 | second section |
| 13 | third section |
| 14 | fourth section |
| 15 | drive member |
| 16 | upper end portion |
| 17 | lower end portion |
| 18 | extension |
| 19 | drive section |
| 20 | drive section |
| 21 | drive section |
| 22 | lower connector |
| 23 | upper connector |
| 24 | rib |
| 25 | enlarged drive member |
| 26 | bore |
| 27 | bore |

-continued

| PART NO. | DESCRIPTION |
|---|---|
| 28 | bore |
| 29 | upper square end portion |
| 30 | lower square end portion |
| 31 | lug |
| 32 | lug |
| 33 | bolt |
| 34 | nut |
| 35 | opening |
| 36 | round plate |
| 37 | triangular plate |
| 38 | shear pin |
| 39 | bolt |
| 40 | nut |
| 41 | opening |
| 42 | opening |
| 43 | die |
| 44 | die |
| 45 | jack |
| 46 | support |
| 47 | clamp |
| 48 | clamp |
| 49 | runway |
| 50 | runway |
| 51 | die support |
| 52 | die support |
| 53 | pipe section |
| 54 | transition section |
| 55 | connector |
| 56 | hydraulic drive |
| 57 | internal drive member |
| 58 | bore |
| 59 | rod |
| 60 | extension |
| 61 | internal thread |
| 62 | external thread |
| 63 | tool stops |
| 64 | stops below drive tool |
| 65 | pin |
| 66 | opening |
| 67 | lower end |
| 68 | fitting |
| 69 | horizontal surface |
| 70 | retainer clamp |
| 71 | retainer clamp |
| 72 | O-ring |
| 73 | socket |
| 74 | socket |
| 75 | opening |
| 76 | concrete |
| A | dimension arrow |
| B | dimension arrow |
| C | dimension arrow |
| D | dimension arrow |

The foregoing embodiments are presented by way of example only; the scope of the present invention is to be limited only by the following claims.

The invention claimed is:

1. A method of installing a piling system comprising the steps of:

a) providing an anchor;

b) providing a plurality of hollowed pile sections that are connectable end to end, and connecting a lowermost of the pile sections to the anchor;

c) providing an internal drive system for transmitting torque to the anchor, said drive system comprising a plurality of sections that are connectable end to end and which extend inside the hollowed pile sections, d) thrusting the anchor into the earth;

e) connecting a first pile section to the helical anchor, the pile section having a bore and an upper and lower end portions, each having a connector;

f) connecting a second pile section to the upper end portion of the first pile section such that a lower end portion of the upper pile section matingly fits into an upper end portion of the lower pile section and engages therewith without threads;

g) driving the anchor and the first and second pile sections into the soil with the internal drive system that includes a plurality of longitudinally extending connected drive members, and wherein the internal drive includes enlarged drive members that are placed at spaced apart positions and which each fit a drive joint between two connected pile sections, registering at the connected end portions of two connected pile sections.

2. The method of claim 1, wherein in step "a" the anchor is a helical anchor.

3. The method of claim 1 further comprising the step of filling the bore of a pile section with a filler material.

4. The method of claim 1 further comprising the step of filling the bore of a pile section with a grout filler material.

5. The method of claim 3 further comprising the step of removing all or part of the drive member before adding the filler material.

6. The method of claim 4, further comprising the step of removing all or part of the drive member before adding the grout material.

* * * * *